United States Patent [19]

Keeton

[11] 4,084,822

[45] Apr. 18, 1978

[54] GOLF PRACTICE DEVICE

[76] Inventor: John H. Keeton, P.O. Box 278, Taylor Blvd., Campbellsville, Ky. 42718

[21] Appl. No.: 732,374

[22] Filed: Oct. 14, 1976

[51] Int. Cl.[2] ..... A63B 69/36

[52] U.S. Cl. ..... 273/185 D; 273/186 C

[58] Field of Search ..... 273/185 D, 185 C, 184 B, 273/200 B, 197 A, 197 R, 200 R

[56] References Cited

U.S. PATENT DOCUMENTS

| | | | |
|---|---|---|---|
| 2,259,918 | 10/1941 | Young | 273/185 D |
| 2,608,864 | 9/1952 | Wagner | 273/185 D |
| 2,656,720 | 10/1953 | Sonnett | 273/185 D X |
| 3,666,271 | 5/1972 | Honnef | 273/185 C |
| 3,738,660 | 6/1973 | Branz et al. | 273/185 D |
| 3,830,504 | 8/1974 | Koo | 273/185 D |

*Primary Examiner*—George J. Marlo
*Attorney, Agent, or Firm*—Cushman, Darby & Cushman

[57] ABSTRACT

A golf practice device that is simple to construct, utilize, and maintain includes a plurality of indicators for indicating various component factors of a golf swing on a golf practice ball. The indicators indicate the distance of a shot, the "push or pull" of the shot, and whether or not there is a hook or slice. The practice device includes a top plate disposed in a given plane, a bottom plate disposed in a plane substantially parallel to the plane of the top plate, a mounting structure for mounting the bottom plate for rotation with respect to the top plate about the first axis, perpendicular to the plane of the top plate, a practice golf ball, a mounting structure for mounting practice golf ball on the bottom plate for rotation with respect to the top and bottom plates about a second axis, parallel to the plane of the top plate, and a mounting structure for mounting the practice golf ball on the bottom plate for rotation with respect to the top and bottom plates about a third axis, perpendicular to the plane of the top plate and parallel to the first axis. An opening is formed in the top plate, and indicia cooperate with the opening and are readable through the opening so that the single opening provides indicia for indicating the distance, hook or slice, and push or pull of the practice ball.

15 Claims, 7 Drawing Figures

GOLF PRACTICE DEVICE

BACKGROUND AND SUMMARY OF THE INVENTION

The invention relates to a golf practice device for indicating a number of component factors of a golf practice swing during which a conventional golf club is brought into contact with a golf practice ball. There are numerous prior art devices — both mechanical and mechanical-electrical — for determining various factors of a golf practice swing. While all such prior art devices are generally useful for indicating various factors of a golf practice swing, as a rule they are fairly limited in the factors of the swing that they do indicate, or else they are extremely complicated mechanical devices that are difficult to construct and utilize. Also, several different readings must be taken off various portions of the prior art apparatus before the factors of the golf swing can be known, and then several different indicators may have to be reset. For instance, one U.S. Patent discloses a golf practice device for indicating the push-pull & distance of a golf practice swing and while the construction is quite simple, it lacks any indication of hook or slice, and provides two different indicia that are quite widely spaced from each other and must be individually read in order to determine the qualities of the practice swing. Additionally, the golf practice ball must be mounted so that it can freely spin about a horizontal axis in order to properly indicate the distance, and such free spinning of the ball can be undesirable since a good deal of hard to control friction losses might be occasioned thereby, and since it provides an unrealistic phenomena. The golf practice device shown in another Patent provides for a large number of factors of a golf swing, including the distance, push or pull, and hook or slice. Such a structure is extremely complicated, however and is difficult to construct and utilize, and provides the indicators for the various factors of the practice stroke at widely spaced positions. In addition, it is necessary that the golf practice ball be swung like a pendulum, which is not a realistic situation and can lead to distraction of the golfer when utilizing the practice device.

According to the present invention, a golf practice device is provided that is simple to construct, utilize and maintain, and one which should be very durable. Also, a plurality of different component factors of a golf practice swing can be measured thereby, even though the structure is simple, and all of the various factors are indicated at a central location, it being necessary to only inspect one area in order to evaluate the swing. Additionally, the structure is very easy to reset, and provides a very realistic indication since the ball when struck during a golf practice swing disappears from view, and does not continuously spin about an axis or extend from a pendulum.

According to one aspect of the present invention, a golf practice device is provided comprising a plate having an opening form therein, indicia cooperating with the opening and readable through the opening, and a practice golf ball rotatable with respect to the plate and adapted to be struck by a club. First means are provided for indicating the push or pull of the practice ball when struck by a club, second means for indicating the distance of travel of the practice ball when struck by a club are provided, and third means for indicating the hook or slice of the practice ball when struck by a club are provided. There are means for mounting the first, second and third indicating means so that all the means cooperate with the plate opening so that the distance, hook or slice, and push or pull of the practice ball may be determined merely by observing the plate opening and indicia cooperating therewith.

According to another aspect of the present invention, a golf practice device is provided including a top plate disposed in a plane, a bottom plate disposed in a plane substantially parallel to the plane of the top plate, and a golf practice ball. Means are provided for mounting the bottom plate for rotation with respect to the top plate about a first axis, perpendicular to the plane of the top plate, means are provided for mounting the practice golf ball on the bottom plate for rotation with respect to said plates about a second axis, parallel to the plane of the top plate, and means are provided for mounting the practice golf ball on the bottom plate for rotation with respect to said plates about a third axis, perpendicular to the plane of the top plate in parallel to said first axis. A plurality of indicating means indicate the amount of movement of the golf ball about said first, second, and third axes. The golf ball is so mounted that it disappears from view once struck, and does not continuously spin and is not mounted from a pendulum, and all of the indicating means can be read at a central portion of the apparatus — an opening in the top plate.

It is a primary object of the present invention to provide a simplified golf practice device for indicating a plurality of component factors of a golf swing, and for providing a single location for readout of the component factors. This and other objects of the invention will become clear from an inspection of the detailed description of the drawings, and from the appended claims.

DETAILED DESCRIPTION OF THE INVENTION

Figure 1:
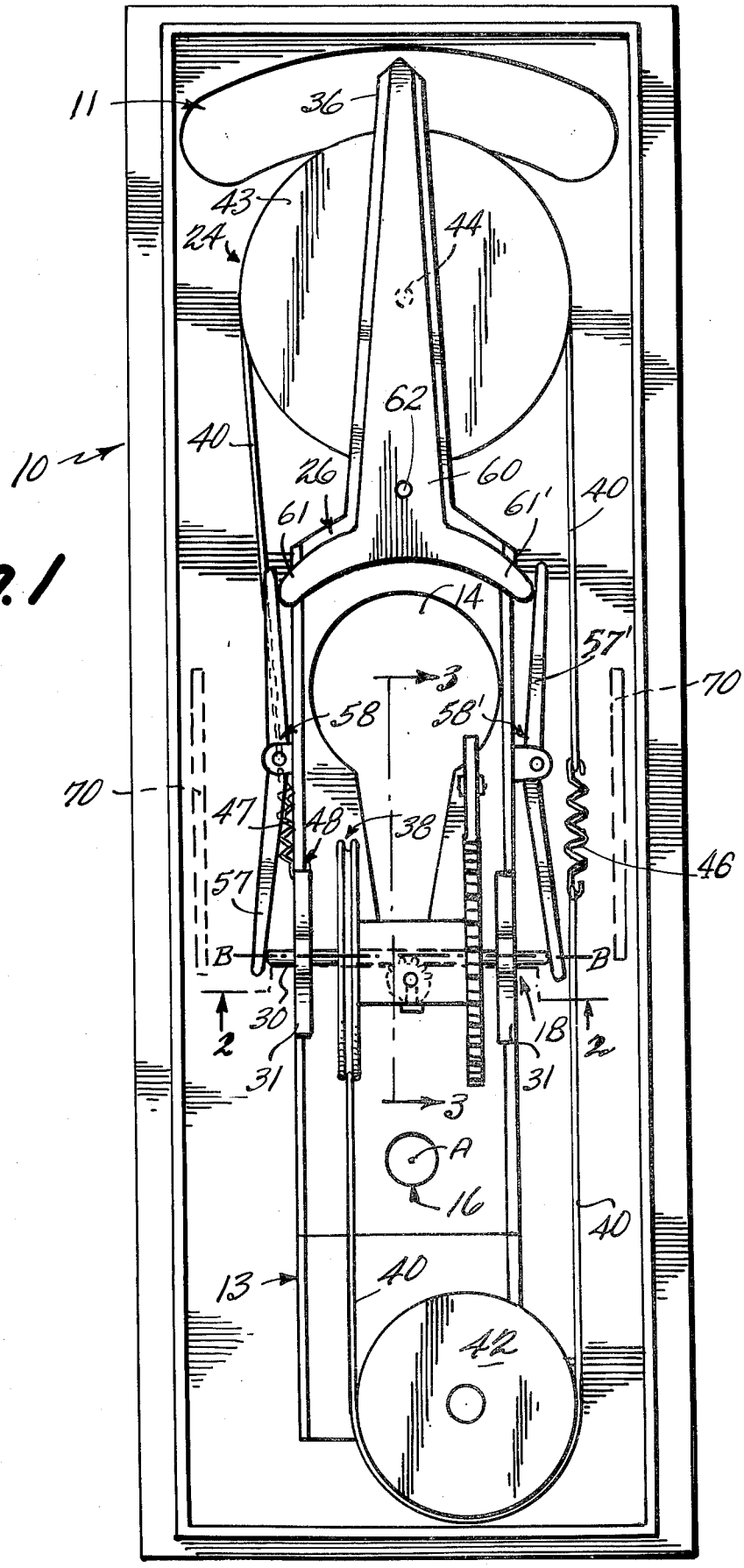
FIG. 1 is a bottom plan view of an exemplary golf practice device according to the present invention.
Figure 5:
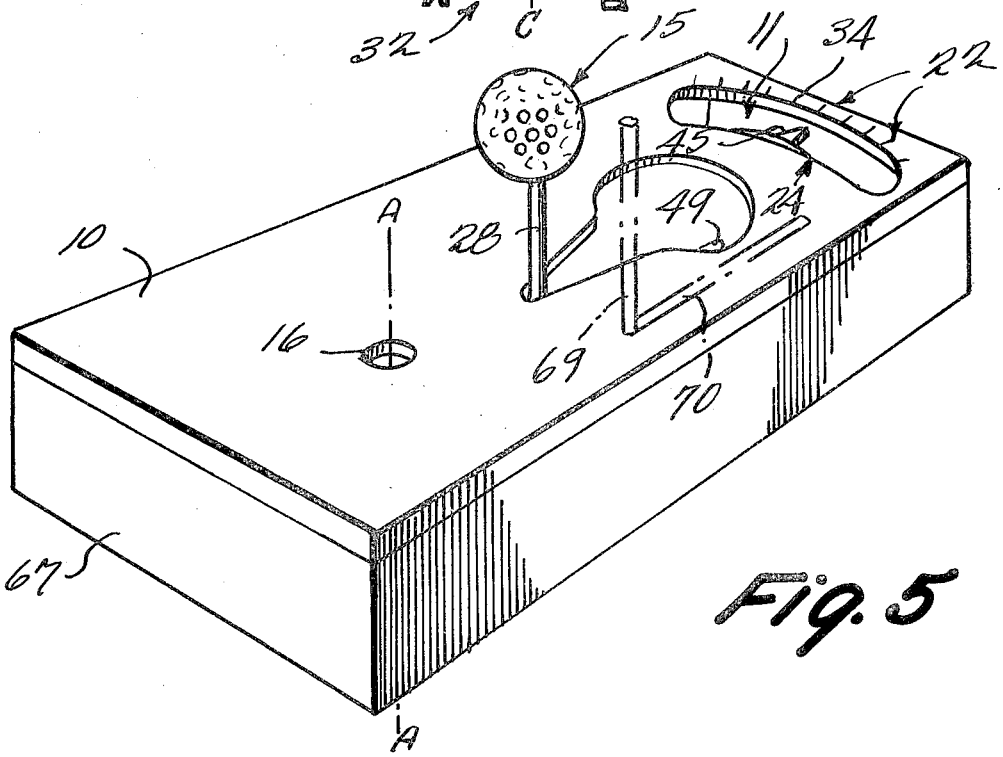
FIG. 5 is a perspective view of exemplary apparatus according to the present invention in use.

Exemplary apparatus according to the present invention includes a top plate 10, an opening 11 in the top plate 10, the opening 11 having indicia cooperating therewith for indicating various component factors of a golf practice swing, a bottom plate 13 disposed in a plane parallel to the plane of the top plate 10, a practice golf ball 15, and an opening 14 in the top plate 10 and bottom plate 13 for the practice golf ball 15, means 16 for mounting the bottom plate 13 for rotation with respect to the top plate 10 about a first axis A—A perpendicular to top plate 10, means 18 for mounting the practice golf ball for rotation about a second axis B—B parallel to the plane of the top plate 10, and means 20 for mounting the practice golf ball 15 on the bottom plate 13 for rotation with respect to the plates 10, 13 about a third axis C—C perpendicular to the plane of the top plate 10 and parallel to the first axis A—A. The first axis A—A is shown most clearly in FIG. 5, the second axis B—B is shown most clearly in FIG. 1, and the third axis C—C is shown most clearly in FIGS. 2 and 3. A plurality of indicating means indicate the amount of movement of the golf ball 15 about the first, second and third axes, said plurality of indicating means including a first indicating means 22 for indicating the push or pull of the practice ball 15 when struck by a club, a second indicating means 24 for indicating the distance of travel of the practice golf ball when struck by a club, and third indicating means 26 for indicating the hook or slice of the practice ball 15 when struck by a club.

The practice golf ball 15 is preferably the same size and shape as a conventional golf ball, and is made out of a relatively hard but resilient material, such as hard rubber. A stem 28 mounts the golf ball 15 and is rigidly fixed to the golf ball 15. Preferably, the stem 28 is also made of hard but resilient material, such as hard rubber, so that should the stem inadvertently be struck from the side (i.e., a blow parallel to axis B—B) the chances of damage to the ball and stem are minimized. The mounting means 16 includes a pivot pin (see FIGS. 1 and 5) which allows for relative rotation of the plate 13 with respect to the plate 10.

The mounting means 18 for mounting the golf ball 15 for rotation about second axis B—B includes a shaft 30, bushings 31 (which extend outwardly from bottom plate 13) for mounting the shaft for rotation about axis B—B, and stem bushing 32 for mounting the stem so that a force perpendicular to both axes A—A and C—C that impacts ball 15 will result in rotation of ball 15 about shaft 30. The mounting means 20 for mounting the golf ball 15 for rotation about third axis C—C includes the stem 28 and the stem bushing 32 for receiving the stem 28, the stem bushing 32 allowing relative rotation between stem 28 and bushing 32.

The first indicating means 22 for indicating the push or pull of the practice ball once struck by a club includes indicia 34 (see FIG. 5) on the top of plate 10 disposed around opening 11, the mounting means 16 for allowing relative rotation between the bottom plate 13 and the top plate 10, and a pointer 36 (see FIG. 1 in particular) that is stationarily mounted to the bottom plate 13, and is removable with bottom plate 13 about axis A—A. If the practice golf ball 15 is "pushed or pulled", this will result in relative rotation of the plate 13 with respect to the to the plate 10 about axis A—A, and will thus result in displacement of pointer 36 from a middle position to one side or other of the opening 11, and the indicia 34 on top plate 10 cooperating with opening 11 may be read to indicate the relative amount of "push or pull".

Figure 2:
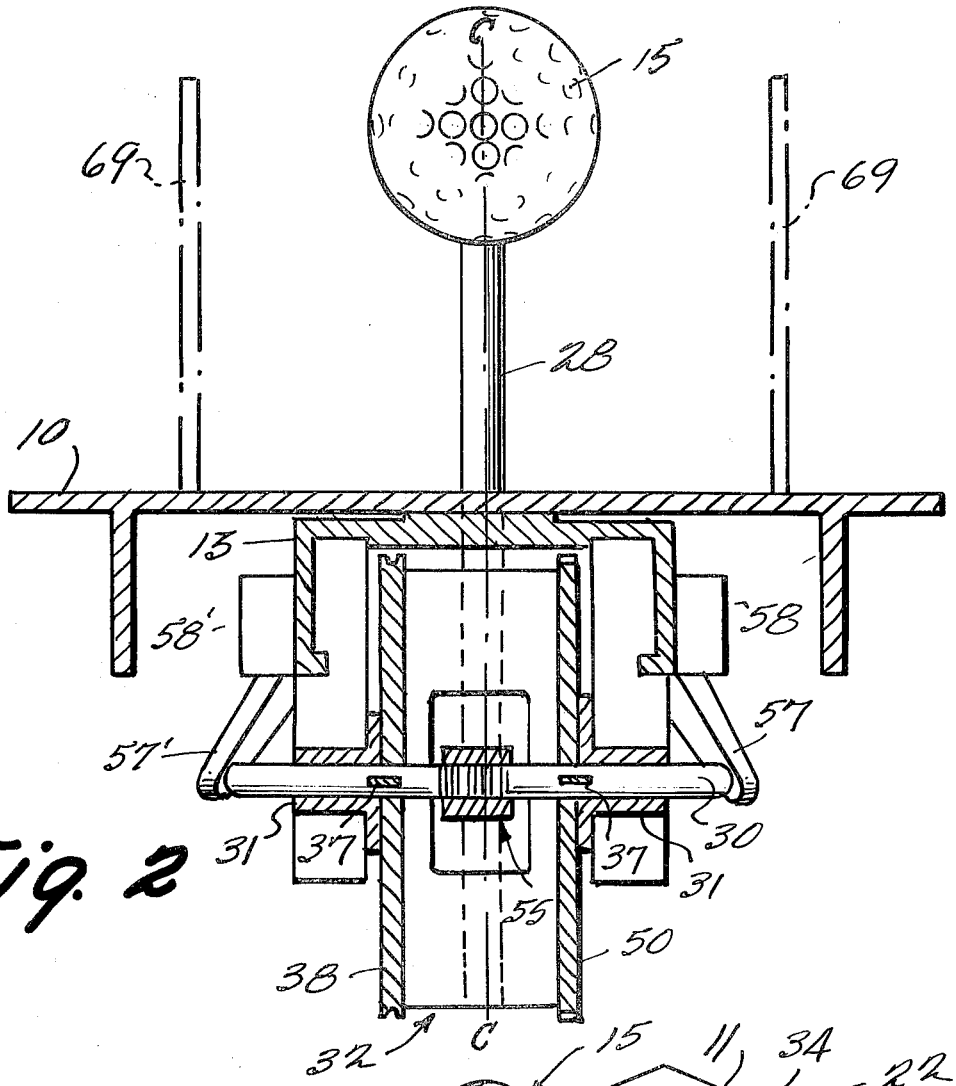
FIG. 2 is a side view, partly in section and partly in elevation, taken along lines 2—2 of FIG. 1.
Figure 3:
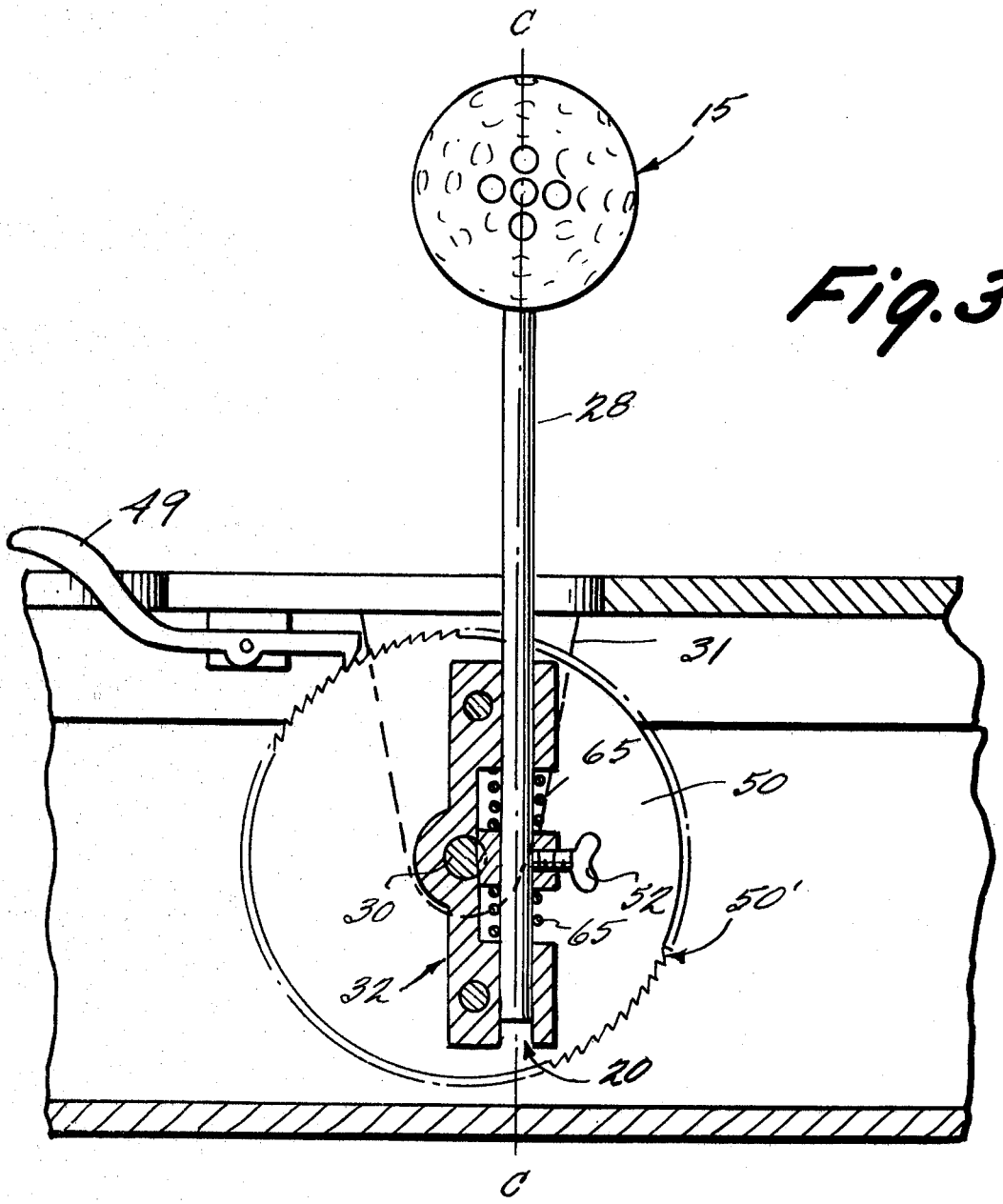
FIG. 3 is a side view, partially in cross-section and partially in elevation, of the apparatus of FIG. 1 taken along lines 3—3 of FIG. 1.

The second indicating means 24 for indicating the distance of travel of the practice golf ball 15 once struck by a club includes a pulley 38 mounted on shaft 30 for rotation about axis B—B, a cord 40 (which is relatively inextensible) that is rigidly affixed to a peripheral portion of pulley 38 so that rotation of pulley 38 results in movement of cord 40, and a pulley 42 pivotally mounted to plate 13 for rotation about in axis perpendicular to the axis B—B of pulley 38. An indicating wheel 43, which is pivotally mounted by pivot pin 44 to the pointer 36 which is affixed to bottom plate 13, includes indicia 45 (see FIG. 5) on the top thereof, the amount of rotation of the indicating wheel 43 about pivot 44 relative to stationary pointer 36 indicating the amount of "distance" of travel of the practice golf ball 15. Springs 46 and 47 are affixed to the cord 40, and upon take-up of the cord 40 by rotation of pulley 38, and subsequent rotation of wheel 43, the springs 46 and 47 will be elongated, the spring constants of the springs 46 and 47 being chosen relative to the indicia 45 so that the force causing extension of the springs 46 and 47 (the force on the golf practice ball 15) corresponds to an actual distance that a golf ball would be hit if subjected to that force. The spring 47 is rigidly attached to bottom plate 13 at one end thereof, by stationary fastener 48. The springs 47 and 46 are also gauged so that the maximum practical revolution of the golf ball 15 about axis B—B is about 270° so that the golf ball 15 when struck will disappear from view below plate 10, and will not spin about axis B—B. The plate 13 of course will limit the amount of travel of ball 15 about axis B—B to about 270°. Preferably, it is desirable to hold the ball in the position to which it is struck until proper readings of the indicating wheel 43 can be taken (through opening 11 — see FIG. 5), and this is accomplished by a ratchet 50 rotatable about axis B—B, affixed to shaft 30, and a pawl 49 cooperating with teeth 50' formed on ratchet 50. Upon release of pawl 49 so that it no longer engages teeth 50' of ratchet 50, the springs 46 and 47 will return the practice ball 15 to its original upstanding position (as shown in FIGS. 2 and 3). The pulley and spring system provided by members 38, 42, 43 40, 46 and 47 provides a simple, easy to construct and durable, readily calibratable and adjustable mechanical indicating system for the distance of travel of a golf practice ball.

Figure 4:
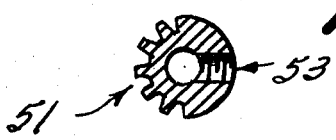
FIG. 4 is a detailed cross-sectional view of the pinion of FIG. 3.
Figure 7:
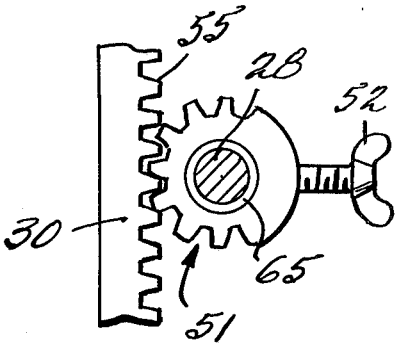
FIG. 7 is a detailed view of the pinion and cooperating shafts of FIG. 3.

The third indicating means 26 for indicating the hook or slice of the practice ball 15 when struck by a club includes the pinion 51 (see FIGS. 3, 4, and 7 in particular) affixed by fastener 52 through fastener opening 53 to the stem 28, rack portion 55 (see FIGS. 2 and 7) of shaft 30 (the bushings 31 allowing axial movement of the shaft 30 with respect thereto, and shaft 30 is keyed to pulley 38 and pawl 50 by splines 37, and bushings 31 and splines 37 being so constructed that they do not interfere with each other) a pair of levers 57, 57', a pair of pivotal mounts 58, 58' for the levers 57, 57', a movable pointer 60, pointer portions 61, 61' for engagement with levers 57, 57' respectively, and pivot pin 62 for mounting the movable pointer 60 for relative rotation with respect to the stationary pointer 36. Additionally, springs 65 provide for a resilient mounting of the shaft 28 and bushing 32 and associated with pinion 51 so that should the ball 15 be subjected to a force along axis C—C, no damage to the stem, ball, or pinion 51 and rack 55 will ensue. When the practice ball 15 is struck by a golf club face so that the rotation is imparted to ball 15 about axis C—C, the rotation of shaft 28 about axis C—C will result — through pinion 51 and rack 55 — in the axial displacement of the shaft 30. This axial displacement of the shaft 30 will cause it to pivot one of the levers 57, 57' about its respective pivot 58, 58', thereby causing the lever to in turn pivot the pointer 60 with respect to stationary pointer 36 about axis 62, and resulting of displacement of the pointer 60 with respect to pointer 36. The relative amount of displacement can also be read utilizing the indicia 34 on the top plate 10 cooperating with opening 11 (see FIG. 5).

In addition to the structure heretofore described, various other features may be provided according to the present invention. For instance, a box 67 could be attached to plate 10, and include all of the structure heretofore described therein. Such a box 67 could merely be installed in a golf practice range or the like, with the plate 10 flush with a horizontal surface on which a golfer would stand, and thus the mounting could be accomplished with a minimal amount of time and effort. Since all of the structures associated with the golf practice device according to the invention are simple mechanical structures, it is believed that they would be very durable, however should any need for repair be necessary, the box 67 could merely be detached from the top plate 10 and ready access would be gained to all of the component parts. Additionally, guards 69 — shown in dotted lines in FIGS. 2 and 5 — could be provided to protect the ball 15 and shaft 28 from a side blow (perpendicular to axis C—C and parallel to axis B—B). The guards 69 would be pivotal into slots 70 (shown in dotted lines in FIGS. 1 and 5) when the golf ball 15 pivoted through opening 14 so that they did not interfere with the follow through of a practice stroke. This could be accomplished in a number of manners, such as mounting the guards 69—69 for rotation about shaft 30, or by other suitable means.

The apparatus according to the present invention having been described, an exemplary mode of operation thereof will not be set forth. With the box 67 installed in a suitable environment so that the top plate 10 is flush with the horizontal surface on which a golfer stands, the ball 15 is disposed in its position (see FIGS. 2 and 3) with the stationary pointer 36 located at the midpoint of opening 11, and the golfer addresses the ball 15. The golfer than takes a practice swing, bringing a conventional golf club face into contact with the ball 15, and the ball 15 pivots about axis B—B in response to the force of the impact by the golf club face thereon. If the swing is completely true so that an actual golf ball hit with such a swing would go completely straight, only distance will be indicated through the opening 11, the pointer 36 not pivoting about axis A—A, and the pointer 60 not pivoting with respect to pointer 36. During rotation about axis B—B, the ball 15 passes through opening 14 into the interior of the box 67, and rotates until the force of the blow is diminished, the springs 46 and 47 being elongated a given amount corresponding to the force. The ball 15 is held in the position to which it is finally moved against the forces of springs 46 and 47 by the pawl and ratchet arrangement 49–50, and the rotation of pulley 38 results in take-up of the cord 40 and subsequent rotation of the indicating wheel 43 with respect to the stationary pointer 36. The distance then may be read by comparing the indicia 45 on the upper surface of wheel 43 with the position of the stationary pointer 36.

If the practice swing was not completely true so that a hook or slice would be imparted to the ball 15 were it an actual ball, the action of the club face on the ball 15 would result in relative rotation of the ball 15 and shaft 28 about axis C—C, with subsequent axial displacement of the shaft 30 by engagement between pinion 50 and rack 55. This relative rotation would result in pivoting of one of the levers 57, 57', with subsequent pivoting — through portions 61, 61' — of the movable pointer 60 about pivot points 62 with respect to the stationary pointer 36. The relative displacement between the pointer 60 and the pointer 36 may be gauged merely by an inspection of the relative positions thereof with respect to indicia 34 formed on the top of plate 10. The action of the hook or slice indicating means 26 does not at all affect the distance indicating means 24.

If the ball 15, when struck by the golf club face during the practice swing, was pushed or pulled (either in addition to or instead of a hook or slice) such a pushing or pulling force would cause the ball 15 and shaft 28 to transmit a force to the bottom plate 13 so that it pivoted about axis A—A with respect to the top plate 10 (the opening 14 being large enough and so shaped to accommodate such pivotal movement). The amount of movement can be gauged in part by the position of the stationary pointer 36 with respect to the indicia 34 on the top of plate 10. The push or pull indicating means 22 does not at all affect the hook or slice indicating means 26 or the distance indicating means 24.

Figure 6:
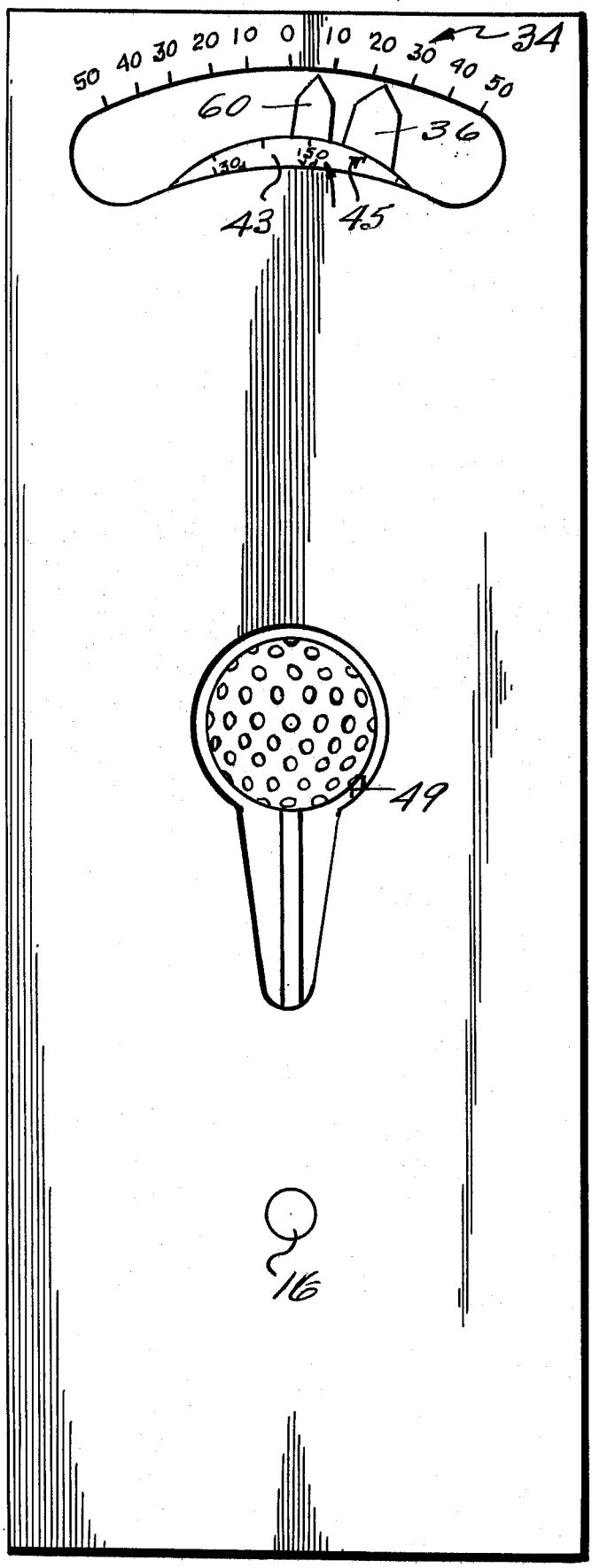
FIG. 6 is a top plan view of the device of FIG. 1 after the ball has been struck.

The displacement of wheel 43 relative to pointer 36 — indicating the distance the ball 15 traveled — and the displacement of pointer 36 relative to indicia 34 — indicating a slice — and the displacement of pointer 60 relative to pointer 36 — indicating that the ball has been pulled — after the ball 15 has been struck are illustrated in FIG. 6.

It will thus be seen that three component factors of a practice golf swing may be read merely by looking at the area of opening 11 in the plate 10, a true indication being provided of the various component factors. In order to reset the apparatus after the golf practice swing, it is merely necessary to depress pawl 49 with the club (which results in the ball 15 being snapped to its original upright position as shown in FIGS. 2 and 3), to position the ball 15 so that the pointer 36 is at the center line of opening 11, and to rotate the ball 15 about axis C—C if necessary to insure that the pointers 36 and 60 coincide. The ball 15 again may be addressed, and another practice swing taken.

It will thus be seen that according to the present invention a simplified mechanical golf practice device for indicating a plurality of component factors of a practice golf swing has been provided. While the invention has been herein shown and described in what is presently considered to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A golf practice device comprising (a) a plate having a first opening formed therein, (b) indicia cooperating with said opening and readable through said first opening, (c) a practice golf ball rotatable with respect to said plate and adapted to be struck by a club, (d) first means for indicating the push or pull of the practice ball when struck by a club.

(e) second means for indicating the distance of travel of the practice ball when struck by a club, (f) third means for indicating the hook or slice of the practice ball when struck by a club, and (g) means for mounting said first, second, and third indicating means so that all said means cooperate with said plate opening so that the distance, hook or slice, and push or pull of the practice ball may be determined merely by observing the plate opening and indicia cooperating therewith.

2. A golf practice device as recited in claim 1 wherein said first indicating means includes a pointer stationarily mounted to a bottom plate disposed in a plane parallel to said plate and readable through said opening, and wherein said means for mounting said first indicating means includes a pivot pin for mounting said bottom plate for rotation with respect to said plate about a first axis, perpendicular to the plane of said plates.

3. A golf practice device as recited in claim 1 wherein said second indicating means includes an indicating wheel having indicia formed on a surface thereof, and readable through said plate opening, and wherein said means for mounting said second indicating means includes means for mounting said practice golf ball for rotation with respect to said plate about a second axis parallel to the plane of said plate.

4. A golf practice device as recited in claim 1 wherein said third indicating means includes a movable pointer pivotally mounted with respect to a stationary pointer which is mounted to a bottom plate rotatable with respect to said plate about a first axis perpendicular to the plane of the plate, said movable pointer being mounted for rotation with respect to said stationary pointer about a third axis perpendicular to the plane of said plates and parallel to said first axis.

5. A golf practice device as recited in claim 1 wherein said plate also includes a second, practice golf ball receiving, opening therein, and further comprising means for mounting said practice golf ball for rotation with respect to said plate so that upon being struck by a club said practice golf ball passes through said second practice golf ball, opening in said plate and stays in that position until reset.

6. A golf practice device comprising (a) a top plate disposed in a plane, (b) a bottom plate, disposed in a plane substantially parallel to the plane of the top plate, (c) means for mounting said bottom plate for rotation with respect to said top plate about a first axis, perpendicular to the plane of said top plate, (d) a practice golf ball, (e) means for mounting said practice golf ball on said bottom plate for rotation with respect to said plates about a second axis, parallel to the plane of said top plate, (f) means for mounting said practice golf ball on said bottom plate for rotation with respect to said plates about a third axis, perpendicular to the plane of said top plate and parallel to said first axis, and (g) a plurality of indicating means for indicating the amount of movement of said golf ball about said first, second, and third axes.

7. A golf practice device as recited in claim 6 wherein said means for mounting said practice golf ball on said bottom plate for rotation about said second axis includes a ball stem attached to the said golf practice ball, a shaft disposed along said second axis, bushings attached to said bottom plate for mounting said shaft for rotation about said second axis, and a stem bushing for mounting said stem for movement with said shaft.

8. A golf practice device as recited in claim 7 wherein said indicating means for indicating the amount of movement of said golf ball about said second axis includes a pulley keyed to said shaft, a relatively inextensible cord fixedly attached to a peripheral portion of said pulley, an indicating wheel, said cord disposed about said indicating wheel for effecting rotation thereof in response to take-up of said cord by said pulley, and a spring attached at one end thereof to said cord and at the other end thereof to said bottom plate.

9. A golf practice device as recited in claim 8 wherein said indicating means further includes a direction changing pulley about which said cord is disposed and located between said indicating wheel and said pulley along the path of said cord, and a second spring connected at each end thereof to said cord, said second spring disposed in association with said cord between said direction changing pulley and said indicating wheel, and a pointer fixedly mounted to said bottom plate and extending from said bottom plate past the periphery of said indicating wheel, said indicating wheel pivotally mounted to said pointer.

10. A golf practice device as recited in claim 6 wherein said means for mounting said practice golf ball on said bottom plate for rotation about siad third axis includes a ball stem rigidly attached to said practice golf ball, and a stem bushing operatively attached to said bottom plate and for allowing rotation of said stem about said third axis with respect to said bottom plate.

11. A golf practice device as recited in claim 10 further comprising spring means associated with said stem bushing and said stem for allowing some movement of said stem along said third axis without damage to said stem or stem bushing.

12. A golf practice device as recited in claim 10 wherein said indicating means for indicating the amount of movement of said golf ball about said third axis includes a pinion, means for mounting said pinion to said stem for rotation therewith, a rack in operative engagement with said pinion, and a movable pointer pivotally mounted to said bottom plate and pivotal with respect to said bottom plate in response to linear movement of said rack by said pinion.

13. A golf practice device as recited in claim 12 wherein said indicating means further comprises a pair of levers disposed on either side of said rack in the directions of linear movement of said rack, means for pivotally mounting said levers and lever engaging portions of said movable pointer for translating pivotal movement of said levers to pivotal movement of said movable pointer, and further comprising a stationary pointer rigidly mounted to said bottom plate, said movable pointer pivotally mounted to said stationary pointer for movement with respect thereto, and relative displacement between said stationary pointer and said movable pointer providing an indication of the amount of movement of said practice golf ball about said third axis.

14. A golf practice device as recited in claim 12 wherein said means for mounting said golf practice ball on said bottom plate for rotation about said second axis includes a shaft disposed along said second axis, and a shaft bushing for mounting said shaft for rotation about said second axis and axial movement along said second axis; and wherein said rack includes a toothed portion of said shaft, linear movement of said shaft along said second axis resulting in pivotal movement of said movable pointer.

15. A golf practice device as recited in claim 6 wherein said top plate includes a golf ball receiving opening therein, and wherein said bottom plate also includes a golf ball receiving opening therein corresponding to said top plate golf ball receiving opening, and wherein said means for mounting said practice golf ball on said bottom plate for rotation about said second axis includes means for holding said golf ball in a position to which it is moved in rotation about said second axis by the force of a club on said golf ball on the opposite side of said bottom plate from said top plate so that said golf ball passes through said golf ball receiving openings in said top and bottom plates when struck, and remains in the position on the opposite side of said bottom plate from said top plate until reset.

* * * * *